United States Patent [19]

Derstadt et al.

[11] 4,116,885

[45] Sep. 26, 1978

[54] ANIONIC SURFACTANT-CONTAINING DETERGENT COMPOSITIONS HAVING SOIL-RELEASE PROPERTIES

[75] Inventors: Donna M. Derstadt; Douglas W. Moeser, both of Cincinnati, Ohio

[73] Assignee: The Procter & Gamble Company, Cincinnati, Ohio

[21] Appl. No.: 836,127

[22] Filed: Sep. 23, 1977

[51] Int. Cl.[2] ..... C11D 1/14; C11D 3/065; C11D 3/20

[52] U.S. Cl. ..... 252/532; 252/526; 252/531; 252/534; 252/536; 252/538; 252/539; 252/540; 252/545; 252/550; 252/551; 252/555; 252/558; 252/559; 252/DIG. 15

[58] Field of Search ..... 252/89, 531, 532, 534, 252/536, 539, DIG. 2, DIG. 15, 546, 526

[56] References Cited

U.S. PATENT DOCUMENTS

| | | | |
|---|---|---|---|
| 3,416,952 | 12/1968 | McIntyre et al. | 427/385 X |
| 3,479,212 | 11/1969 | Robertson et al. | 427/158 |
| 3,563,905 | 2/1971 | Schmadel et al. | 252/545 |
| 3,712,873 | 1/1973 | Zenk | 260/29.2 E |
| 3,893,929 | 7/1975 | Basadur | 252/8.6 |
| 3,959,230 | 5/1976 | Hays | 260/75 R |
| 3,962,152 | 6/1976 | Nicol et al. | 252/551 |
| 4,000,093 | 12/1976 | Nicol et al. | 252/529 |
| 4,020,015 | 4/1977 | Bevan | 252/544 |

FOREIGN PATENT DOCUMENTS

| | | |
|---|---|---|
| 1,154,730 | 6/1969 | United Kingdom. |
| 1,377,092 | 12/1974 | United Kingdom. |

*Primary Examiner*—P.E. Willis, Jr.
*Attorney, Agent, or Firm*—Steven J. Goldstein; Robert B. Aylor; Richard C. Witte

[57] ABSTRACT

Detergent compositions, particularly effective in removing oily soils from hydrophobic fibers, such as polyester, are disclosed, containing specific anionic surface-active agents, polyester soil-release polymers, and which may contain only limited amounts of certain incompatible anionic surface-active agents. The process of laundering fabrics in aqueous solutions of these compositions is also disclosed.

23 Claims, No Drawings

ANIONIC SURFACTANT-CONTAINING DETERGENT COMPOSITIONS HAVING SOIL-RELEASE PROPERTIES

BACKGROUND OF THE INVENTION

The present invention relates to detergent compositions which contain selected anionic surface-active agents together with polyester soil-release copolymer, and which contain, at most, only limited amounts of specific types of incompatible anionic surface-active agents. These compositions clean soiled fabrics, and provide a soil-release benefit for both greasy/oily and body soils (such as facial, collar and cuff soils) on synthetic fabrics, particularly polyesters, when used in an aqueous laundering system. The detergent compositions herein permit the use of the disclosed soil-release polymers together with surfactant systems containing a broad range of surface-active agents. In addition, the compositions herein tend to inhibit the redeposition of soils onto fabrics during the laundering operation, and also improve the water absorption characteristics of polyester garments, thereby affording the wearer greater comfort.

Much effort has been expended in designing compositions which are capable of conferring soil-release properties to fabrics woven from polyester fibers. These fibers are mostly copolymers of ethylene glycol and terephthalic acid, and are sold under a number of trade names, for example, Dacron, Fortrel, Kodel, and Blue-C Polyester. The hydrophobic character of polyester fabrics makes their laundering, particularly as regards oily soils and stains, difficult, principally due to the inherently low wettability of the polyester fibers. Since the character of the fiber itself is hydrophobic (or oleophilic), once an oily soil is deposited on the fabric, it becomes bound to its surface. As a result, the oily soil or stain is difficult to remove in a conventional aqueous laundering operation.

It is well-recognized that an oily soil is much more easily removed from a hydrophilic fabric, such as cotton, than it is from a hydrophobic polyester fabric. This difference in oil removal characteristics is apparently caused by the greater affinity of cotton fabrics for water and surfactant.

The differing hydrophilic/hydrophobic characteristics of cotton and polyester are due in part to the basic building blocks of the fibers themselves. Since polyester fibers are copolymers of terephthalic acid and ethylene glycol, they have less affinity for water because they possess fewer free hydrophilic groups, i.e., hydroxyl or carboxyl groups, where hydrogen bonding can occur. With cotton, which is a cellulose material, the large number of hydrophilic groups provides compatibility with, and affinity for, water.

In terms of detergency, the most important difference between hydrophobic and hydrophilic fabrics is the tendency for oily soils to form easily removable droplets when present on a hydrophilic fabric in contact with water and surfactant. The mechanical action of washing and the action of synthetic detergents and builders, normally used in the washing step of the laundering process, removes such oily droplets from the fabric. This droplet formation is in contrast to the situation which exists with a polyester hydrophobic fiber. Since water does not wick well through hydrophobic fabrics, the oily soil tends to be retained throughout the fabric, both because of the inherent hydrophobic character of the fabric and the lack of affinity of oily soils for water.

Since polyester and polyester blend fabrics, such as polyester/cotton blends, are popular and are susceptible to oily staining, manufacturers of polyester fibers and fabrics have sought to increase the hydrophilic character of the polyester, in order to provide ease of laundering for the consumer.

A variety of approaches to the problem of increasing the hydrophilic character of polyester fabrics and fabric blends has been taken. Many of these approaches involve a treating process employed by the fiber or textile manufacturer. For example, U.S. Pat. No. 3,712,873, Zenk, issued Jan. 23, 1973, discloses the use of polyester polymers, in combination with quaternary ammonium salts, as fabric-treating compositions. Terpolymers having a molecular weight in the range of from 1,000 to 100,000 and a terephthalic acid:polyglycol:glycol molar ratio of about 4.5:3.5:1 are disclosed. These compositions are applied by spraying or padding them onto textiles containing polyester or polyamide synthetic materials, for the purpose of improving the soil-release characteristics of these materials. U.S. Pat. No. 3,959,230, Hays, issued May 25, 1976; U.S. Pat. No. 3,479,212, Robertson et al, issued Nov. 18, 1969; and U.S. Pat. No. 3,416,952, McIntyre et al, issued Dec. 17, 1968, also disclose the use of ethylene terephthalate/-polyethylene oxide terephthalate copolymers in the manufacture or treatment of polyester articles, for the purpose of providing them with enhanced hydrophilic character, and hence improved removal of oily soils.

It has been suggested that soil-release polymers may be incorporated into detergent compositions, so that when polyester-containing fabrics are washed in aqueous solutions of these compositions, the fabrics will be modified in order to improve the removal, upon subsequent washing, of oil-containing stains. Even if the fabrics are treated by the manufacturer, the treatment benefit is diminished as the fabrics age, mainly due to removal of the soil-release polymer through washing in ordinary detergent products. Thus, the use of detergent compositions containing soil-release polymers provide laundered fabrics with an ongoing soil-release benefit. U.S. Pat. No. 3,962,152, Nicol et al, issued June 8, 1976, discloses the use of specific low ratio ethylene terephthalate/polyethylene oxide terephthalate copolymers in solid detergent compositions.

The use of relatively high ratio ethylene terephthalate/polyethylene oxide terephthalate soil-release polymers together with nonionic surfactants, in detergent compositions, is known in the art. British Patent Specification No. 1,377,092, Bevan et al, published Dec. 11, 1974, teaches the use of such copolymers in detergent compositions containing nonionic surfactants. It is indicated that the presence of anionic surfactants in those detergent compositions should be avoided, since such surfactants decrease the soil-release properties of the compositions. Further, U.S. Pat. No. 4,020,015, Bevan, issued Apr. 26, 1977, discloses a process by which terephthalate copolymers or cellulose ether soil-release agents are dispersed in a water-soluble, detergent-compatible carrier, for use in a granular laundry detergent composition. Once again, it is taught that the presence of anionic surfactants in such compositions decreases soil-release performance.

The use of nonionic surface-active agents in solid-form detergent compositions, particularly spray-dried detergent compositions, presents various processing and packaging problems. Nonionic surfactants tend to be oily and, thus, exist as a separate phase when placed in a crutcher mix, prior to spray-drying. Such nonhomogeneity in the crutcher mix is intolerable when preparing a homogeneous spray-dried detergent granule. Further, in terms of packaging, the presence of large amounts of nonionic surfactant in a detergent composition may cause the surfactant component to wick through the package or container holding the composition. Thus, there are clear advantages in the use of anionic, instead of nonionic, surfactants in such laundry detergent compositions. Copending U.S. Patent application Ser. No. 699,412, Nicol, filed June 24, 1976, discloses detergent compositions, containing ethylene terephthalate/polyethylene oxide terephthalate soil-release copolymers, which may also contain anionic surfactants. However, these compositions require the presence of free hardness or other cations in the laundry solution in order to yield adequate soil-release performance. It has now been found that by using particularly selected anionic surfactants together with the soil-release copolymers, built anionic laundry detergent compositions, which are particularly effective in producing a soil release effect for oily soils on hydrophobic fabrics, may be formulated.

It is a primary object of this invention to provide detergent compositions which exhibit excellent cleaning performance while concurrently imparting soil-release properties to hydrophobic fabrics laundered therewith, and which do not require the presence of free hardness or other cations in the laundry solution to achieve this result.

It is another object of this invention to provide detergent compositions which inhibit the redeposition of soils onto fabrics during the laundering operation, and which additionally enhance the water absorption capacity of polyester garments.

It is yet another object of this invention to provide anionic surfactant-containing detergent compositions which may be fully built, and which contain specifically defined ethylene terephthalate/polyethylene oxide terephthalate soil-release ingredients.

It is a further object of this invention to provide detergent compositions comprising soil-release polymers having specific molar ratios of ethylene terephthalate and polyethylene oxide terephthalate.

It is a further object of this invention to provide a laundering method for the improved removal of oily soils from hydrophobic fibers.

SUMMARY OF THE INVENTION

The present invention encompasses laundry detergent compositions capable of simultaneously cleaning and imparting improved soil-release characteristics to fabrics, especially hydrophobic fabrics, such as polyesters. The compositions herein comprise:

(a) from about 0.15% to about 25% by weight of a soil-release polymer comprising ethylene terephthalate and polyethylene oxide terephthalate in a molar ratio of ethylene terephthalate to polyethylene oxide terephthalate of from about 50:50 to 90:10, said polyethylene oxide terephthalate containing polyethylene oxide linking units having a molecular weight of from about 600 to about 5,000; and (b) from about 5% to about 95% of compatible anionic surfactants selected from the group consisting of nonethoxylated $C_8$–$C_{18}$ alcohol sulfates, $C_5$–$C_{13}$ alcohol sulfates condensed with from about 1 to 30 moles of ethylene oxide, $C_{14}$–$C_{20}$ alcohol sulfates condensed with from about 4 to 30 moles of ethylene oxide, and mixtures thereof;

wherein no more than about 10% of said detergent composition constitutes other types of anionic surfactants. In preferred compositions, no more than about 25% of the total anionic surfactant components contained in said composition is an incompatible surfactant selected from the group consisting of linear alkylbenzene sulfonates having from about 8 to 18 carbon atoms in the alkyl group, $C_{14}$–$C_{20}$ alcohol sulfates condensed with from about 1 to 3 moles of ethylene oxide, and mixtures thereof.

The compositions herein may also contain various optional adjunct materials commonly employed in laundry detergent compositions.

A method of laundering for the improved removal of oily soils and stains from hydrophobic fibers, utilizing the disclosed detergent compositions, is also taught herein.

DETAILED DESCRIPTION OF THE INVENTION

Soil-Release Polymer

The compositions of the instant invention contain from about 0.15% to about 25%, preferably from about 0.25% to about 15%, more preferably from about 0.5% to about 10%, by weight, of a soil-release polymer containing ethylene terephthalate groups, having the formula:

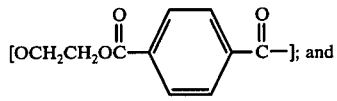

polyethylene oxide terephthalate groups, having the formula:

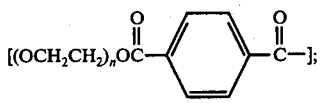

wherein the molar ratio of ethylene terephthalate to polyethylene oxide terephthalate in the polymer is from about 50:50 to about 90:10. The molecular weight of the polyethylene oxide linking units is in the range of from about 600 to about 5,000, i.e., $n$ in the above formula is an integer of from about 14 to 110. The polymers may have an average molecular weight in the range of from about 5,000 to about 200,000. The polymers are also characterized by a random polymeric structure, i.e., all possible combinations of ethylene terephthalate and polyethylene oxide terephthalate may be present.

Preferred polymers are those having ethylene terephthalate/polyethylene oxide terephthalate molar ratios of from about 65:35 to about 90:10, preferably from about 65:35 to about 80:20, containing polyethylene oxide linking units having a molecular weight of from about 750, preferably about 1,000, to about 3,000, and having a polymer molecular weight of from about 10,000 to about 50,000. An example of a commercially available polymer of this type is available from ICI United States, Inc., and is sold under the tradename Milease T, as described in ICI Technical Bulletin 431R.

Examples of the polymers which may be utilized in the present invention appear in Table 1, below.

TABLE 1

| | A | B | C | D |
|---|---|---|---|---|
| Moles of ethylene terephthalate (ET) | 70 | 50 | 70 | 90 |
| Moles of ethylene oxide terephthalate (EOT) | 30 | 50 | 30 | 10 |
| Molecular weight of ethylene oxide in EOT | 1496 | 1144 | 704 | 4400 |
| Molecular weight of polymer | 20,000 | 50,000 | 40,000 | 100,000 |

The soil-release polymers herein are substantive to hydrophobic fabrics, particularly polyesters, under laundry conditions, apparently resulting from the presence of the hydrophobic ethylene oxide terephthalate groups.

The soil-release polymers used in this invention can be prepared by conventional polymerization processes known in the art, using those molar ratios of precursor materials which provide the critical ratios of ethylene terephthalate: polyethylene oxide terephthalate set forth above. As an example, the processes described in U.S. Pat. No. 3,479,212, Robertson et al, issued Nov. 18, 1969, incorporated herein by reference, can be used for preparing operable polymers herein by selecting the proper monomer precursors. A preferred group of polymers for use herein is prepared according to the following technique: 194 g. dimethyl terephthalate, 155 g. ethylene glycol, 420 g. polyethylene oxide (molecular weight 1540), 0.44 g. 2,6-di-tert-butyl-4-methylphenol, and 0.0388 g. antimony trioxide are mixed in a reaction vessel and heated from 194° C. to 234° C., with stirring, over a 4.5 hour period. During this time, methanol is distilled from the reaction vessel. Following the addition of 0.141 g. of a 24.8% solution of phosphorous acid in ethylene glycol to the foregoing reaction mixture, the molten mixture is transferred to a polymerization tube, and heated to 282° C. After the excess glycol has been blown off in a rapid stream of nitrogen, the pressure is reduced to 0.1 mm of mercury and polymerization is continued for 15 minutes. Dispersions of the polymer prepared in this manner can be made by mixing the molten polymer with water in a Waring blender.

Surfactant Component

The detergent compositions of the present invention comprise from about 5 to about 95%, preferably from about 5 to about 35%, and most preferably from about 10 to about 25%, by weight, of specifically defined compatible anionic surfactant. These surfactants include the compounds obtained by sulfating $C_8$–$C_{18}$ alcohols ($C_8$–$C_{18}$ alcohol sulfates), the products obtained by sulfating $C_5$–$C_{13}$ alcohols which are condensed with from about 1 to 30 moles of ethylene oxide, the compounds obtained by sulfating $C_{14}$–$C_{20}$ alcohols which are condensed with from about 4 to 30 moles of ethylene oxide, and mixtures of these surfactants. Such surfactants are well-known in the detergency art, and are fully described in *Surface Active Agent, by Schwartz and Perry, Interscience Publishers, Inc., New York,* 1949, incorporated herein by reference, particularly Volume I, pages 53–66.

Preferred non-ethoxylated alcohol sulfates for use in the compositions of the present invention are those made from $C_{10}$–$C_{18}$, particularly $C_{10}$–$C_{15}$, alcohols. Preferred ethoxylated alcohol sulfates include those containing an average of from about 1 to 10 ethylene oxide groups, and those synthesized from $C_8$–$C_{13}$, particularly $C_{10}$–$C_{13}$, alcohols. Alcohol sulfate ethoxylates, formed from $C_{14}$–$C_{18}$ alcohols and containing an average of from about 4 to 10 moles of ethylene oxide, are also preferred for use herein. Particularly preferred anionic surfactants for use in the compositions of the present invention include $C_{10\text{-}11}$ alcohol sulfate, $C_{12\text{-}13}$ alcohol sulfate, $C_{14\text{-}15}$ alcohol sulfate, tallow alcohol sulfate, $C_{12}$ alcohol sulfate condensed with about 1 mole of ethylene oxide, $C_{12\text{-}13}$ alcohol sulfate condensed with about 2 moles of ethylene oxide, $C_{12\text{-}13}$ alcohol sulfate condensed with about 3 moles of ethylene oxide, $C_{13}$ alcohol sulfate condensed with about 2 moles of ethylene oxide, $C_{14\text{-}15}$ alcohol sulfate condensed with about 7 moles of ethylene oxide, and mixtures of these surfactants.

The compositions of the present invention are also formulated so as not to contain more than about 10%, preferably no more than about 5%, of anionic surfactants, other than those compatible surfactants, enumerated above. Preferred compositions are ones in which no more than about 25%, preferably no more than about 15%, most preferably no more than about 5%, of the total anionic surfactant component contained in the composition is made up of linear alkylbenzene sulfonates having from about 8 to 18 carbon atoms in the alkyl group, $C_{14}$–$C_{20}$ alcohol sulfates condensed with from about 1 to 3 moles of ethylene oxide, and mixtures of these surfactants. These surfactants are also well-known in the detergency arts and are fully described in Schwartz and Perry, supra, incorporated herein by reference. The presence of these incompatible surfactants, even in the relatively small amounts defined above, dramatically decreases the soil-release performance of the compositions of the present invention, even where the compatible surfactants, defined above, are also included. Preferred compositions are those in which the amount of $C_{14}$–$C_{15}$ alcohol sulfates condensed with from about 1 to 3 moles of ethylene oxide and linear alkylbenzene sulfonates having from about 11 to 18 carbon atoms in the alkyl chain, particularly $C_{14\text{-}15}$ alcohol sulfate condensed with about 2.5 moles of ethylene oxide, $C_{14\text{-}15}$ alcohol sulfate condensed with about one mole of ethylene oxide, linear alkylbenzene sulfonate having an average of 11.2 carbon atoms in the alkyl chain, and linear alkylbenzene sulfonate having an average of 11.8 carbon atoms in the alkyl chain, are limited as described above. Particularly preferred compositions of the present invention are substantially free (containing no more than about 1 or 2% by weight) of these incompatible anionic surfactants.

The compositions of the present invention may also contain other types of surface-active agents widely used in laundry detergent compositions, as long as the compatible surfactants, defined above, are included, and the amount of incompatible surfactants included in the compositions, as defined above, is limited. Thus, in one embodiment, the compositions of the present invention contain from about 1% to about 20%, preferably from about 2% to about 15% of a nonionic, zwitterionic, or ampholytic cosurfactant, or a mixture of such cosurfactants. It is preferred, when the compositions of the present invention are formulated in solid-form, such as granules or powder, that they contain no more than about 10%, preferably no more than about 5%, and most preferably no more than about 2%, of nonionic cosurfactants, since the presence of higher amounts of such cosurfactants may result in processing and packaging problems, as discussed above. Such cosurfactants are well-known in the detergency arts and are more particularly described in U.S. Pat. No. 3,717,630, Booth, issued Feb. 20, 1973, and U.S. Pat. No. 3,332,880, Kessler et al, issued July 25, 1967, both of which are incorporated herein by reference. Nonlimiting examples of cosurfactants suitable for use in the instant compositions are as follows:

Most commonly, nonionic surfactants are compounds produced by the condensation of an alkylene oxide, especially ethylene oxide (hydrophilic in nature) with an organic hydrophobic compound, which is usually aliphatic or alkyl aromatic in nature. The length of the hydrophilic polyoxyalkylene moiety which is condensed with any particular hydrophobic compound can be readily adjusted to yield a water-soluble compound having the desired degree of balance between hydrophilic and hydrophobic properties. Examples of suitable nonionic surfactants herein include:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, said ethylene oxide being present in an amount equal to 5 to 25 moles of ethylene oxide per mole of alkyl phenol. The alkyl substituent in such compounds can be derived, for example, from polymerized propylene, diisobutylene, and the like. Examples of compounds of this type include nonyl phenol condensed with about 9.5 moles of ethylene oxide per mole of nonyl phenol; dodecyl phenol condensed with about 12 moles of ethylene oxide per mole of phenol; dinonyl phenol condensed with about 15 moles of ethylene oxide per mole of phenol; and di-isooctylphenol condensed with about 15 moles of ethylene oxide per mole of phenol. Commercially available nonionic surfactants of this type include Igepal CO-630 marketed by the GAF Corporation; and Triton X-45, X-114, X-100 and X-102, all marketed by the Rohm and Haas Company.

(2) The condensation products of aliphatic alcohols with ethylene oxide. The alkyl chain of the aliphatic alcohol can be either straight or branched and generally contains from about 8 to about 22 carbon atoms. Examples of such ethoxylated alcohols include the condensation product of about 6 moles of ethylene oxide with 1 mole of tridecanol; myristyl alcohol condensed with about 10 moles of ethylene oxide per mole of myristyl alcohol; the condensation product of ethylene oxide with coconut fatty alcohol wherein the coconut alcohol is a mixture of fatty alcohols with alkyl chains varying from 10 to 14 carbon atoms in length and wherein the condensate contains an average of about 6 moles of ethylene oxide per mole of alcohol; and the condensation product of about 9 moles of ethylene oxide with the above-described coconut alcohol. Examples of commercially available nonionic surfactants of this type include Tergitol 15-S-9 marketed by Union Carbide Corporation, Neodol 23-6.5 marketed by Shell Chemical Company and Kyro EOB marketed by The Procter & Gamble Company.

(3) The condensation products of ethylene oxide with a hydrophobic base formed by the condensation of propylene oxide with propylene glycol. The hydrophobic portion of these compounds has a molecular weight of from about 1500 to 1800 and, of course, exhibits water insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product. Examples of compounds of this type include certain of the commercially available Pluronic surfactants marketed by Wyandotte Chemicals Corporation.

(4) The condensation products of ethylene oxide with the product resulting from the reaction of propylene oxide and ethylene diamine. The hydrophobic moiety of these products consists of the reaction product of ethylene diamine and excess propylene oxide, said moiety having a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by Wyandotte Chemicals Corporation.

Nonionic surfactants may also be of the semi-polar type including water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxides containing one alkyl moiety of about 10 to 28 carbon atoms and 2 moieties selected from the group consisting of alkyl groups and hydroxyalkyl groups containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

Another nonionic surfactant useful herein comprises a mixture of "surfactant" and "co-surfactant" as described in the application of Collins, Ser. No. 406,413, filed Oct. 15, 1973, the disclosures of which are incorporated herein by reference. The term "nonionic surfactant" as employed herein encompasses these mixtures of Collins.

Ampholytic surfactants include derivatives of aliphatic heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic quarternary ammonium, phosphonium, and sulfonium compounds in which the aliphatic moieties can be straight or branched chain, and wherein one of the aliphatic substituents contains from about 8 to 18 carbon atoms and one contains an anionic water-solublizing group. Particularly preferred zwitterionic materials are the ethoxylated ammonium sulfonates and sulfates disclosed in U.S. Pat. No. 3,925,262, Laughlin et al, issued Dec. 9, 1975, U.S. Pat. No. 3,929,678, Laughlin et al, issued Dec. 30, 1975 and U.S. Pat. No. Application Ser. No. 603,837, Laughlin et al, filed Aug. 11, 1975, all of which are incorporated herein by reference. The inclusion of these specific zwitterionic surfactants in the compositions of the present invention provides detergent compositions which give excellent clay soil and oily stain removal performance on polyester fabrics.

Particularly preferred ethoxylated zwitterionic surfactants are those having the formulae:

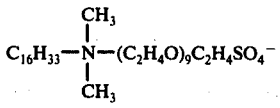

and

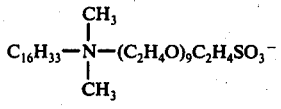

Additional preferred zwitterionic surfactants include those having the formula

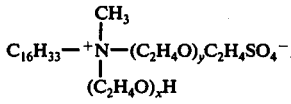

wherein the sum of $x + y$ is equal to about 15.

The detergent compositions of the present invention may include detergency builder salts, especially alkaline polyvalent anionic builder salts. These alkaline salts serve to maintain the pH of the cleaning solution in the range of from about 7 to about 12, preferably from about 8 to about 11, and enable the surfactant component to provide effective cleaning even where hardness cations are present in the laundry solution. It is preferred that the builder salts be present in an amount of from about 1% to about 60%, preferably from about 10% to about 50%, by weight of the compositions; although by the proper selection of surfactants and other components, effective detergent compositions which are free or essentially free of builder salts may be formulated for use herein. Due to environmental considerations, a preferred embodiment of the present invention contains no more than about 25% phosphate builder materials.

Suitable detergent builder salts useful herein can be of the polyvalent inorganic or polyvalent organic types, or mixtures of these varieties. Nonlimiting examples of suitable water-soluble, inorganic alkaline detergent builder salts include: alkali metal carbonates, borates, phosphates, polyphosphates, bicarbonates, silicates, and sulfates. Specific examples of such salts include the sodium and potassium tetraborates, perborates, bicarbonates, carbonates, tripolyphosphates, orthophosphates, pyrophosphates and hexametaphosphates.

Examples of suitable organic alkaline detergency builder salts include:

(1) water-soluble aminopolyacetates, for example, sodium and potassium ethylenediamine tetraacetates, nitrilotriacetates, and N-(2-hydroxyethyl)nitrilotriacetates;

(2) water-soluble salts of phytic acid, for example, sodium and potassium phytates; and (3) water-soluble polyphosphonates, including sodium, potassium, and lithium salts or ethane-1-hydroxy-1,1-diphosphonic acid; sodium, potassium, and lithium salts of methylenediphosphonic acid; and the like.

Additional organic builder salts useful herein include the polycarboxylate materials described in U.S. Pat. No. 3,364,103, incorporated herein by reference, including the water-soluble alkali salts of mellitic acid. The water-soluble salts of polycarboxylate polymers and copolymers, such as those described in U.S. Pat. No. 3,308,067, incorporated herein by reference, are also suitable as builders herein.

While the alkali metal salts of the organic and inorgainc polyvalent anionic builder salts and compatible anionic surfactants previously disclosed are preferred for use herein from an economic standpoint, the ammonium, and alkanolammonium, such as triethanolammonium, diethanolammonium, monoethanolammonium, and the like, water-soluble salts of any of the foregoing compatible detergent and builder anions may also be used herein.

A further class of detergency builder materials useful in the present invention are insoluble sodium aluminosilicates, particularly those described in Belgian Pat. No. 814,874, issued Nov. 12, 1974, incorporated herein by reference. This patent discloses and claims detergent compositions containing sodium aluminosilicates having the formula $Na_z(AlO_2)_z(SiO_2)_y XH_2O$, wherein $z$ and $y$ are integers equal to at least 6, the molar ratio of $z$ to $y$ is in the range of from 1.0:1 to about 0.5:1, and X is an integer from about 15 to about 264, said aluminosilicates having a calcium ion exchange capacity of at least 200 milligrams equivalent/gram and a calcium ion exchange rate of at least about 2 grains/ gallon/minute/gram. A preferred material is $Na_{12}(SiO_2.AlO_2)_{12}.27H_2O$.

Mixtures of organic and/or inorganic builders may be used herein. One such mixture of builders is disclosed in Canadian Patent 755,038, incorporated herein by reference, and consists of a ternary mixture of sodium tripolyphosphate, trisodium nitrilotriacetate, and trisodium ethane-1-hydroxy-1,1-diphosphonate.

Other preferred builder materials which may be used in the compositions of the present invention include alkali metal carboxymethyltartronates, commercially available as about 76% active together with about 7% ditartronate, about 3% diglycolate, about 6% sodium carbonate and about 8% water; and anhydrous sodium carboxymethylsuccinate, commercially available as about 76% active together with about 22.6% water and a mixture of other organic materials, such as carbonates.

While any of the foregoing alkaline polyvalent builder materials are useful herein, sodium tripolyphosphate, sodium nitrilotriacetate, sodium mellitate, sodium citrate, and sodium carbonate are preferred for use as builders. Sodium tripolyphosphate is especially preferred as a builder, both by virture of its detergency building activity and its ability to suspend illite and kaolinite clay soils and to retard their redeposition on the fabric surface.

Bleaching agents may also be incorporated into the compositions of the present invention. Examples of typical bleaching agents are chlorinated trisodium phosphate and the sodium and potassium salts of dichloroisocyanuric acid.

The compositions of the present invention may also include other adjunct materials commonly found in conventional detergent compositions. Examples of such components include various soil suspending agents, such as carboxymethylcellulose, corrosion inhibitors, dyes, fillers, such as sodium sulfate and silica, optical brighteners suds suppressing agents, germicides, pH adjusting agents, antiwrinkling agents, enzymes, enzyme stabilizing agents, perfumes, fabric-softening and static-control agents, and the like.

The compositions of the present invention are used in the laundering process by forming an aqueous solution containing from about 0.01 (100 ppm) to 0.35% (3,500 ppm), preferably from about 0.03 to 0.3%, and most preferably from about 0.05 to about 0.25%, of the detergent compositions of the present invention, and agitating the soiled fabrics in that solution. The fabrics are then rinsed and dried. When used in this manner, the compositions of the present invention yield excellent cleaning and provide a soil-release benefit for oily soils which the fabrics thereafter pick up, particularly in terms of the removal of oily soils from hydrophobic fibers, such as polyester. Repeated use of the compositions increases the soil release effect obtained.

All percentages, parts and ratios used herein are by weight unless otherwise specified.

The following nonlimiting examples illustrate the compositions and method of the present invention.

EXAMPLE I

The soil release capabilities of the compositions of the present invention were tested in the following manner. Unless otherwise specified, the sulfate and sulfonate surfactants, used in all the examples of the present application, are in the form of sodium salts.

An automatic miniature washer was filled with 1.5 gallons of artifically softened water at 100° F. 7 grains per gallon of hardness ions (3/1 calcium:magnesium ratio) were added to the wash water. A sufficient amount of the particular surfactant component to be tested was then added to the wash water as a 5% aqueous solution, so as to give a surfactant concentration of 168 parts per million in the wash solution. Milease T, a preferred polymer of the present invention, commercially available from ICI United States, was then added, as a 5% aqueous suspension, so as to give a concentration of 20 parts per million in the wash solution. The wash solution was agitated for two minutes. Three 5 × 5 inches white 100% polyester knit fabric swatches and five 11 × 11 inches cotton terry cloth fabric swatches were added to the wash solution, agitated for 10 minutes and then spun. The machine then repeated the washing and spinning cycles and the fabrics were dried. The entire washing and drying procedure was then repeated on each set of fabrics.

Six of the dried polyester swatches were stained, at their centers, with approximately 100 microliters of dirty motor oil dispensed from a repeating microsyringe. The swatches were allowed to age overnight, with stains generally wicking out to have a diameter of from about 1 to 1.5 inches. The reflectance of the swatches was then read using a Gardner colorimeter (½ inch aperature, "L" reading only). The value at the center of the stain ($L_b$) and the value for the white background area ($L_v$) were determined for each swatch.

Three of the six stained swatches were than washed, together with five cotton terry swatches, in an automatic miniature washer, using the procedure described in the prewash stage, above. The detergent composition used was Tide, a commercially available built detergent composition manufactured by the Procter & Gamble Company, at a concentration of 1,200 parts per million in the wash solution. No soil release polymer was used in this final wash stage. This final wash procedure was repeated for the remaining three stained swatches for each treatment. After drying, the reflectance of each stain was determined on the Gardner colorimeter ($L_a$). For each swatch, the percent stain removal was calculated using the following formula:

$$\% \text{ Removal} = \frac{L_a - L_b}{L_v - L_b} \times 100$$

The percent removal for each treatment was calculated by taking the average over the six swatches, and these results, for the various surfactants used in the prewash stage, are given in the table below. A control wherein Milease T was used alone in the prewash stage, followed by Tide in the final wash, and a control not using any Milease T, with Tide in the final wash are included for comparison.

| Surfactant In Prewash | % Removal |
|---|---|
| Milease T alone | 86 |
| Tide alone (no Milease T) | 10 |
| Tallow alcohol sulfate | 78 |
| $C_{14-15}$ alcohol sulfate | 53 |
| $C_{12-13}$ alcohol sulfate | 61 |
| *$C_{14-15}$ alcohol sulfate containing an average 2.25 moles of ethylene oxide (hereinafter referred to as $(EO)_{2.25}$) | 20 |
| *$C_{11.2}$ linear alkylbenzene sulfonate | 28 |
| *$C_{11.8}$ linear alkylbenzene sulfonate | 17 |
| $C_{12-13}$ alcohol sulfate | 64 |
| $C_{12}$ alcohol sulfate $(EO)_1$ | 73 |
| $C_{13}$ alcohol sulfate $(EO)_2$ | 70 |
| $C_{12-13}$ alcohol sulfate $(EO)_3$ | 57 |
| *$C_{14-15}$ alcohol sulfate $(EO)_1$ | 12 |
| $C_{12-13}$ alcohol sulfate | 48 |
| $C_{12-13}$ alcohol sulfate $(EO)_2$ | 53 |

*denotes incompatible surfactant

These data demonstrate the excellent soil release performance obtained when the soil-release polymer is combined with a compatible anionic surfactant in the prewash stage, and the dramatic decrease in soil release performance where the polymer is combined with one of the incompatible surfactants during the prewash stage.

Substantially the same results are achieved when soil-release polymers A through D, as set forth in Table 1, above, are used in the above procedure in place of the Milease T soil-release polymer.

Substantially similar results are also obtained when the detergent composition used in the prewash stage additionally contains from about 1 to 60% of a detergency builder material, such as a water-insoluble aluminosilicate builder, e.g., hydrated Zeolite A with a particle size of 1 to 10 microns, sodium tripolyphosphate, sodium pyrophosphate, sodium carbonate, or sodium 2-oxy-1,1,3-propane tricarboxylate.

Equivalent results are also obtained where the detergent compositions used in the prewash phase additionally contain from about 1 to about 20% of a cosurfactant selected from the group consisting of nonylphenol condensed with about 9.5 moles of ethylene oxide, dodecylphenol condensed with about 12 moles of ethylene oxide, dinonylphenol condensed with about 15 moles of ethylene oxide, diisooctylphenol condensed with about 15 moles of ethylene oxide, tridecanonyl phenol condensed with about 6 moles of ethylene oxide, myristyl alcohol condensed with about 10 moles of ethylene oxide, coconut fatty alcohol condensed with about 6 moles of ethylene oxide, coconut fatty alcohol condensed with about 9 moles of ethylene oxide, $$C_{16}H_{33}-\overset{CH_3}{\underset{CH_3}{\overset{|}{\underset{|}{N^{+}}}}}-(C_2H_4O)_9C_2H_4SO_4^{-},$$

-continued

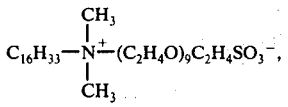

and mixtures of these surfactants.

EXAMPLE II

Using the procedure described in Example I, the soil-release performance of the following detergent comositions was evaluated. The results are summarized in the following table, which sets forth the particular surfactant used together with the Milease T polymer in the prewash phase, and the percent removal obtained from that detergent composition.

| Surfactant in Prewash | % Removal |
|---|---|
| $C_{9-11}$ alcohol sulfate | 89 |
| $C_{9-11}$ alcohol sulfate $(EO)_3$ | 85 |
| $C_{9-11}$ alcohol sulfate $(EO)_6$ | 87 |
| $C_{9-11}$ alcohol sulfate $(EO)_8$ | 86 |
| Milease T alone | 90 |
| $C_{12-13}$ alcohol sulfate | 90 |
| $C_{12-13}$ alcohol sulfate $(EO)_3$ | 82 |
| $C_{12-13}$ alcohol sulfate $(EO)_6$ | 88 |
| $C_{12-13}$ alcohol sulfate $(EO)_9$ | 91 |
| Milease T alone | 93 |
| $C_{14-15}$ alcohol sulfate | 69 |
| $C_{14-15}$ alcohol sulfate $(EO)_{2.25}$ | 14 |
| $C_{14-15}$ alcohol sulfate $(EO)_6$ | 89 |
| $C_{14-15}$ alcohol sulfate $(EO)_9$ | 88 |
| Milease T alone | 89 |
| $C_{12-13}$ alcohol sulfate | 85 |
| $C_{12-13}$ alcohol sulfate $(EO)_3$ | 88 |
| $C_{12-13}$ alcohol sulfate $(EO)_{6.5}$ | 89 |
| $C_{14-15}$ alcohol sulfate $(EO)_7$ | 90 |
| Tide alone (no Milease T) | 15 |

*denotes incompatible surfactant

EXAMPLE III

A granular laundry detergent composition, having the formulation given below, was prepared in the following manner.

| Component | Weight % |
|---|---|
| $C_{12-13}$ alcohol sulfate $(EO)_2$ | 14.0 |
| Sodium aluminosilicate (Zeolite A) | 15.0 |
| Sodium pyrophosphate | 11.7 |
| Sodium silicate (2.0r) | 12.0 |
| Polyethylene glycol 6000 | 0.9 |
| Sodium polymetaphosphate-$(NaPO_3)_{21}$ | 0.9 |
| Milease T | 1.7 |
| Sodium sulfate and minors | balance to 100 |

The Milease T, polyethylene glycol 6000, and sodium polymetaphosphate components were mixed together and formed into coflakes. The remaining components were mixed together in a crutcher, spray-dried to form granules, and mixed together with the coflakes such that the final product had the composition given above.

The soil release capabilities of this composition was tested as follows. Two identical six pound loads, consisting of 41% cotton fabric, 47% polyester/cotton fabric and 12% polyester fabric, were prepared. Twelve $5\frac{1}{2} \times 5\frac{1}{2}$ inches polyester double-knit swatches were included in bundle A, and three such swatches were included in bundle B. Bundle B was washed in Tide, a commercially available built laundry detergent manufactured by The Procter & Gamble Comapny. Bundle A was washed four times with the above composition, with three of the polyester swatches being removed after each wash. The bundles were dried between washes.

The swatches were stained and aged as described in Example I, above. The bundle B swatches were then washed again with Tide, while the twelve bundle A swatches were washed with the composition given above. All washes in this example were carried out in a Kenmore Model 80 automatic washer, in 100° F. Cincinnati city water (8–10 grains/gallon of hardness), using one cup (77 grams) of detergent.

The average percent removal was determined, using a Gardner colorimeter, as described in Example I. The results obtained are summarized below.

| Prewashes | Final Wash | % Removal |
|---|---|---|
| One Tide wash | One Tide wash | 14 |
| One wash with Milease T | One wash with Milease T | 15 |
| Two washes with Milease T | One wash with Milease T | 53 |
| Three washes with Milease T | One wash with Milease T | 77 |
| Four washes with Milease T | One wash with Milease T | 87 |

These data demonstrate the excellent soil release performance obtained as the compositions of the present invention are used over time.

Substantially similar results are obtained where the anionic surfactant used in the above composition is replaced, in whole or in part, by $C_{10}$–$C_{11}$ alcohol sulfate, $C_{12}$–$C_{13}$ alcohol sulfate, $C_{14}$–$C_{15}$ alcohol sulfate, $C_{12}$ alcohol sulfate condensed with about one mole of ethylene oxide, $C_{12}$–$C_{13}$ alcohol sulfate condensed with about three moles of ethylene oxide, $C_{13}$ alcohol sulfate condensed with about two moles of ethylene oxide, $C_{14}$–$C_{15}$ alcohol sulfate condensed with about 7 moles of ethylene oxide, and mixtures of those surfactants.

Similar results are also obtained where soil release polymers A through D, as set forth in Table 1, above, are used in place of the Milease T soil release polymer.

Equivalent results are also obtained where the detergent composition additionally contains from about 1 to about 20% of a cosurfactant selected from the group consisting of

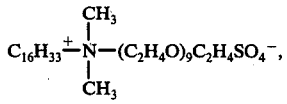

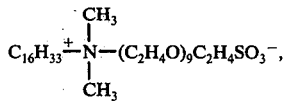

and mixtures of these surfactants.

Good results are also obtained where the detergent compositions contain no more than about 10% of cosurfactants selected from the group consisting of: nonylphenol condensed with about 9.5 moles of ethylene oxide, dodecylphenol condensed with about 12 moles of ethylene oxide, dinonylphenol condensed with about 15 moles of ethylene oxide, diisooctylphenol condensed with about 15 moles of ethylene oxide, tridecanonylphenol condensed with about 6 moles of ethylene oxide, myristyl alcohol condensed with about 10 moles of ethylene oxide, coconut fatty alcohol condensed with about 6 moles of ethylene oxide, coconut fatty alcohol condensed with about 9 moles of ethylene oxide, and mixtures of these surfactants.

EXAMPLE IV

A granular laundry detergent composition, having the formulation given below, is made using the procedure outlined in Example III, above. In addition to forming a coflake, the Milease component may also be combined with the polyethylene glycol 6000 component as described in U.S. Pat. No. 4,020,015, Bevan, issued Apr. 26, 1977, incorporated herein by reference.

| Component | Weight % |
|---|---|
| $C_{12-13}$ alcohol sulfate | 14.0 |
| Sodium tripolyphosphate | 25.0 |
| Sodium silicate (2.0r) | 11.5 |
| Polyethylene glycol 6000 | 0.9 |
| Milease T | 1.7 |
| Sodium sulfate and minors | balance to 100 |

The above composition provides both excellent cleaning and soil-release benefits to fabrics laundered therewith. Substantially similar results are obtained where the above composition additionally contains sodium $C_{11.8}$ linear alkylbenzene sulfonate, at a level of about 1%.

EXAMPLE V

A granular laundry detergent composition, having the formulation given below, is made using the procedure described in Example III, above. This composition, which contains no phosphate components, yields excellent cleaning and soil-release benefits to fabrics laundered with it.

| Component | Weight % |
|---|---|
| $C_{14-15}$ alcohol sulfate $(EO)_7$ | 20.0 |
| Sodium aluminosilicate (Zeolite A) | 25.0 |
| Sodium silicate (2.4r) | 20.0 |
| Polyethylene glycol 6000 | 0.9 |
| Milease T | 1.7 |
| Sodium sulfate and minors | balance to 100 |

Substantially similar results are obtained where the above composition additionally contains $C_{14-15}$ alcohol sulfate $(EO)_1$, at a level of about 3%.

EXAMPLE VI

A granular laundry detergent composition, containing no phosphate components, and having the formulation given below is produced using the method described in Example III. This composition provides excellent cleaning, as well as a soil-release benefit, to fabrics laundered with it.

| Component | Weight % |
|---|---|
| $C_{12-13}$ alcohol sulfate $(EO)_2$ | 16.0 |
| Sodium carbonate | 20.0 |
| Sodium silicate (2.4r) | 20.0 |
| Polyethlene glycol 6000 | 0.9 |
| Milease T | 1.7 |
| Sodium sulfate and minors | balance to 100 |

What is claimed is:

1. A laundry detergent composition comprising:

(a) from about 0.15% to about 25% by weight of a soil-release polymer comprising ethylene terephthalate and polyethylene oxide terephthalate at a molar ratio of ethylene terephthalate to polyethylene oxide terephthalate of from about 50:50 to about 90:10, said polyethylene oxide terephthalate containing polyethylene oxide linking units having a molecular weight of from about 600 to about 5,000; and (b) from about 5% to about 95% of compatible anionic surfactants selected from the group consisting of nonethoxylated $C_8$–$C_{18}$ alcohol sulfates, $C_5$–$C_{13}$ alcohol sulfates condensed with from about 1 to 30 moles of ethylene oxide, $C_{14}$–$C_{20}$ alcohol sulfates condensed with from about 4 to 30 moles of ethylene oxide, and mixtures thereof;

wherein from 0 to about 10% of said detergent composition constitutes other types of anionic surfactants and, further, wherein from 0 to about 25% of the total anionic surfactant components contained in said composition is an incompatible surfactant selected from the group consisting of linear alkylbenzene sulfonates having from about 8 to 18 carbon atoms in the alkyl group, $C_{14}$–$C_{20}$ alcohol sulfates condensed with from about 1 to 3 moles of ethylene oxide, and mixtures thereof.

2. The composition according to claim 1 wherein the soil-release polymer has a molar ratio of ethylene terephthalate to polyethylene oxide terephthalate of from about 65:35 to about 80:20, said polyethylene oxide terephthalate containing polyethylene oxide linking units having a molecular weight of from about 1,000 to about 3,000, the molecular weight of said soil-release polymer being in the range of from about 10,000 to about 5,000.

3. The composition according to claim 1 wherein the compatible anionic surfactant included in said composition is selected from the group consisting of $C_{10}$–$C_{18}$ alcohol sulfates, $C_8$–$C_{13}$ alcohol sulfates condensed with from about 1 to 10 moles of ethylene oxide, $C_{14}$–$C_{18}$ alcohol sulfates condensed with from about 4 to 10 moles of ethylene oxide, and mixtures thereof.

4. The composition according to claim 2 wherein the compatible anionic surfactant included in the composition is selected from the group consisting of $C_{10}$–$C_{18}$ alcohol sulfates, $C_8$–$C_{13}$ alcohol sulfates condensed with from about 1 to 10 moles of ethylene oxide, $C_{14}$–$C_{18}$ alcohol sulfates condensed with from about 4 to 10 moles of ethylene oxide, and mixtures thereof.

5. The composition according to claim 3 wherein from 0 to about 5% of said composition constitutes other types of anionic surfactants.

6. The composition according to claim 4 which contains from about 5% to about 35% of said compatible anionic surfactant.

7. The composition according to claim 6 wherein the compatible anionic surfactant contained in said composition is selected from the group consisting of $C_{10}$–$C_{15}$ alcohol sulfates, $C_{10}$–$C_{13}$ alcohol sulfates condensed with from about 1 to 10 moles of ethylene oxide, $C_{14}$–$C_{18}$ alcohol sulfates condensed with from about 4 to 10 moles of ethylene oxide, and mixtures thereof.

8. The composition according to claim 7 wherein the compatible anionic surfactant contained in said composition is selected from the group consisting of $C_{10}$–$C_{11}$ alcohol sulfate, $C_{12}$–$C_{13}$ alcohol sulfate, $C_{14}$–$C_{15}$ alcohol sulfate, $C_{12}$ alcohol sulfate condensed with about one mole of ethylene oxide, $C_{12-13}$ alcohol condensed with about 2 moles of ethylene oxide, $C_{12}$–$C_{13}$ alcohol sulfate condensed with about three moles of ethylene oxide, $C_{13}$ alcohol sulfate condensed with about two moles of ethylene oxide, $C_{14-15}$ alcohol sulfate condensed with about 7 moles of ethylene oxide, and mixtures thereof.

9. The composition according to claim 6 wherein from 0 to about 25% of the total anionic surfactant contained in said composition is an incompatible surfactant selected from the group consisting of $C_{14}$–$C_{20}$ alcohol sulfates condensed with from about 1 to 3 moles of ethylene oxide, linear alkyl benzene sulfonates having from about 8 to 18 carbon atoms in the alkyl chain, and mixtures thereof.

10. The composition according to claim 9 which is solid in form and which contains from 0 to about 10% of nonionic cosurfactants.

11. The composition according to claim 10 which is solid in form and which contains from 0 to about 5% of nonionic cosurfactants.

12. The composition according to claim 9 wherein from 0 to about 25% of the total anionic surfactant contained in said composition is an incompatible surfactant selected from the group consisting of $C_{14}$–$C_{20}$ alcohol sulfates condensed with from about 1 to 3 moles of ethylene oxide, linear alkyl benzene sulfonates having from about 11 to 18 carbon atoms in the alkyl chain, and mixtures thereof.

13. The composition according to claim 12 wherein from 0 to about 25% of the total anionic surfactant contained in said composition is an incompatible surfactant selected from the group consisting of $C_{14}$–$C_{15}$ alcohol sulfate condensed with about 2.5 moles of ethylene oxide, $C_{14}$–$C_{15}$ alcohol sulfate condensed with about one mole of ethylene oxide, linear alkyl benzene sulfonate having an average of 11.2 carbon atoms in the alkyl chain, linear alkyl benzene sulfonate having an average of about 11.8 carbon atoms in the alkyl chain, and mixtures thereof.

14. The composition according to claim 13 wherein said incompatible surfactant constitutes from 0 to about 15% of the total anionic surfactant contained in said composition.

15. The composition according to claim 14 wherein said incompatible surfactant constitutes from 0 to about 5% of the total anionic surfactant contained in said composition.

16. The composition according to claim 15 which is substantially free of said incompatible surfactants.

17. The composition according to claim 12 which contains from about 1 to about 60% of a detergency builder salt.

18. The composition according to claim 17 which contains from about 10 to about 50% of a detergency builder salt.

19. The composition according to claim 17 which contains from about 1 to about 20% of a cosurfactant selected from the group consisting of nonionic surfactants, zwitterionic surfactants, ampholytic surfactants, and mixtures thereof.

20. The composition according to claim 19 wherein said cosurfactant is selected from the group consisting of:

$$C_{16}H_{33}-\overset{\overset{CH_3}{|}}{\underset{\underset{CH_3}{|}}{N}}-(C_2H_4O)_9C_2H_4SO_4^-;$$

$$C_{16}H_{33}-\overset{\overset{CH_3}{|}}{\underset{\underset{CH_3}{|}}{N}}-(C_2H_4O)_9C_2H_4SO_3^-;$$

and mixtures thereof.

21. The composition according to claim 12 which contains from about 0.25 to about 15% of said soil-release polymer.

22. The composition according to claim 17 containing no more than about 25% phosphate materials.

23. A process for laundering fabrics, particularly suitable for enhancing the release of oily soils picked up thereafter on polyester fabrics, comprising the agitation of said fabrics in an aqueous solution containing from about 0.01 to about 0.35L% of the detergent composition of claim 1.

* * * * *

UNITED STATES PATENT AND TRADEMARK OFFICE

CERTIFICATE OF CORRECTION

PATENT NO. : 4,116,885

DATED : September 26, 1978

INVENTOR(S) : Donna M. Derstadt and Douglas W. Moeser

It is certified that error appears in the above-identified patent and that said Letters Patent are hereby corrected as shown below:

Column 1, line 9 "copolymer", should be -- copolymers --.

Column 1, lines 45 and 46, no new paragraph.

Column 10, line 4, "gainc", should be -- ganic --.

Column 13, line 12, "comositions", should be -- compositions --.

Column 16, line 31, "5,000", should be -- 50,000 --.

Column 18, line 39, "0.35L%", should be -- 0.35% --.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*